US008474665B2

(12) United States Patent
Arvizu

(10) Patent No.: US 8,474,665 B2
(45) Date of Patent: Jul. 2, 2013

(54) RE-SEALABLE SPIGOT FOR A COLLAPSIBLE BEVERAGE CONTAINER

(75) Inventor: Gilbert Arvizu, Rancho Mirage, CA (US)

(73) Assignee: Sports Pouch Beverage Co., Inc., Rancho Mirage, CA (US)

( * ) Notice: Subject to any disclaimer, the term of this patent is extended or adjusted under 35 U.S.C. 154(b) by 0 days.

(21) Appl. No.: 12/570,122

(22) Filed: Sep. 30, 2009

(65) Prior Publication Data

US 2010/0084436 A1 Apr. 8, 2010

Related U.S. Application Data

(63) Continuation-in-part of application No. 12/178,888, filed on Jul. 24, 2008, and a continuation of application No. PCT/US2009/051774, filed on Jul. 24, 2009.

(51) Int. Cl.

| | |
|---|---|
| ***B65D 88/54*** | (2006.01) |
| ***B65D 35/00*** | (2006.01) |
| ***B65D 83/00*** | (2006.01) |
| ***G01F 11/04*** | (2006.01) |
| ***B67D 1/00*** | (2006.01) |

(52) U.S. Cl.
USPC ..... 222/525; 222/523; 222/153.14; 222/107; 215/311; 215/387

(58) Field of Classification Search
USPC ..... 222/525, 528, 529, 531, 532, 546, 222/562, 559, 518, 519, 520, 521, 522, 523, 222/524, 153.06, 153.07, 153.14, 107, 105; 215/200–364, 387; 383/80, 904, 906, 104, 383/5; 220/270
See application file for complete search history.

(56) References Cited

U.S. PATENT DOCUMENTS

| | | | | | |
|---|---|---|---|---|---|
| 3,071,271 | A | * | 1/1963 | Thomas | 215/224 |
| 3,581,926 | A | * | 6/1971 | Roder | 215/330 |
| 4,524,876 | A | * | 6/1985 | Kusz | 215/224 |
| 4,666,063 | A | * | 5/1987 | Holoubek et al. | 222/107 |
| 5,022,562 | A | | 6/1991 | Lurkis et al. | |
| 5,564,591 | A | | 10/1996 | Christine et al. | |
| 5,699,924 | A | * | 12/1997 | Mascio et al. | 215/252 |
| 5,810,185 | A | * | 9/1998 | Groesbeck | 215/387 |
| 5,813,575 | A | | 9/1998 | Glynn et al. | |
| 5,829,611 | A | * | 11/1998 | Beck | 215/252 |

(Continued)

FOREIGN PATENT DOCUMENTS

JP 2000103454 A 4/2000

OTHER PUBLICATIONS

International Search Report and Written Opinion for International Application No. PCT/US2009/051774 dated Sep. 4, 2009.

(Continued)

*Primary Examiner* — Kevin P Shaver
*Assistant Examiner* — Stephanie E Williams
(74) *Attorney, Agent, or Firm* — Arent Fox LLP

(57) ABSTRACT

A re-sealable spigot includes a cylindrical structure configured to be attached to a liquid receptacle. The cylindrical structure is formed with a stem having an upper portion, a base portion, a top in coaxial arrangement with the upper portion, and a cap having a hollow receiving portion shaped as a multi-sided geometrical element, the cap sealing the cylindrical structure to the liquid receptacle.

4 Claims, 5 Drawing Sheets

U.S. PATENT DOCUMENTS

| | | | | |
|---|---|---|---|---|
| 5,971,182 | A * | 10/1999 | Berge et al. | 215/252 |
| 5,975,369 | A * | 11/1999 | Yurkewicz et al. | 222/153.06 |
| 6,000,578 | A * | 12/1999 | Boissay | 222/83 |
| 6,000,848 | A * | 12/1999 | Massioui | 383/80 |
| 6,079,589 | A * | 6/2000 | Matsuyama et al. | 220/715 |
| 6,095,375 | A * | 8/2000 | Adams et al. | 222/182 |
| 6,241,122 | B1 * | 6/2001 | Araki et al. | 222/92 |
| 6,257,463 | B1 | 7/2001 | De Polo | |
| 6,286,733 | B1 * | 9/2001 | Francois | 222/525 |
| 6,758,359 | B2 | 7/2004 | Yurkewicz et al. | |
| 6,805,261 | B1 | 10/2004 | Laudenberg | |
| 6,854,888 | B1 | 2/2005 | Brown et al. | |
| 6,874,664 | B1 * | 4/2005 | Montgomery | 222/525 |
| 7,066,360 | B2 * | 6/2006 | Hearld et al. | 222/525 |
| 7,661,560 | B2 * | 2/2010 | Murray | 222/107 |
| 2001/0027984 | A1 * | 10/2001 | Ichikawa | 222/464.3 |
| 2004/0155071 | A1 * | 8/2004 | Higgins | 222/525 |
| 2005/0092785 | A1 | 5/2005 | Hearld et al. | |
| 2005/0147329 | A1 * | 7/2005 | Arvizu | 383/104 |
| 2006/0138138 | A1 * | 6/2006 | Mishra | 220/270 |
| 2007/0025648 | A1 | 2/2007 | Micnerski et al. | |
| 2007/0133909 | A1 | 6/2007 | Arvizu | |
| 2007/0262100 | A1 | 11/2007 | Murray | |
| 2008/0185405 | A1 | 8/2008 | Murray | |

OTHER PUBLICATIONS

International Preliminary Report on Patentability (IPRP) for PCT/US2009/051774 issued by the IPEA/US on Feb. 28, 2011.

Office Action for Chinese Patent Application No. 200980134434.8 issued by the State Intellectual Property Office on Feb. 20, 2012.

* cited by examiner

RE-SEALABLE SPIGOT FOR A COLLAPSIBLE BEVERAGE CONTAINER

CROSS-REFERENCE TO RELATED APPLICATIONS

The present Application for Patent claims priority to PCT Application No. PCT/US2009/051774, entitled "Re-Sealable Spigot for a Collapsible Beverage Container," filed on Jul. 24, 2009, which claims priority to U.S. patent application Ser. No. 12/178,888, entitled "Re-Sealable Spigot for a Collapsible Beverage Container," filed on Jul. 24, 2008. Of which the contents of these applications are expressly incorporated herein by reference.

BACKGROUND

1. Field

The present disclosure relates generally to beverage containers, and more particularly to a re-sealable spigot for collapsible beverage containers.

2. Background

Flexible containers made from paperboard or metal foil are often used to package various beverages for retail distribution. These flexible containers are often packaged with a separate straw wrapped in cellophane and secured to the outside of the container. The straw may be removed by the consumer and used to puncture a sealed spout as the straw is inserted into the container. Once the straw is inserted, the consumer may withdraw the beverage from the container.

The use of a straw secured to a beverage container has numerous drawbacks. Packaging a straw together with the container can be costly and inefficient, requiring not only an additional manufacturing step to make the straw and cellophane wrap, but yet another manufacturing step to wrap the straw with the cellophane and secure it to the container. When the consumer uses the straw, the cellophane wrap is discarded, resulting in waste. The insertion of the straw through the sealed spout into the container can also be difficult, and often results in the beverage squirting up through the spout. If the entire beverage is not consumed, then it will go to waste for there is no easy way to reseal the spout once it is punctured. Moreover, the straw is prone to dislodge from the container before use, making the consumption of the beverage very difficult, if not impossible.

Accordingly, there is a need for a re-sealable spigot for a collapsible beverage container that is commercially viable to produce for retail distribution. The beverage container should not require the use of a straw to consume the beverage and should have a mechanism to reseal the container in the event that the beverage is not completely consumed.

SUMMARY

One aspect of a re-sealable spigot is disclosed. A re-sealable spigot includes a cylindrical structure configured to be attached to a liquid receptacle, wherein said cylindrical structure further comprises a stem, having an upper portion and a base portion, and a top in a coaxial arrangement with said upper portion of said stem, and a cap having a hollow receiving portion shaped as a multi-sided geometrical element, wherein said cap seals said cylindrical structure.

Another aspect of a re-sealable spigot is disclosed. A re-sealable spigot includes a cylindrical structure configured to be attached to a liquid receptacle, comprising a stem, said stem having an upper portion and a base portion, and a top in a coaxial arrangement with said upper portion of said stem, and a multi-sided cap having a hollow receiving portion, wherein said cap temporarily seals said cylindrical structure.

It is understood that other embodiments of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments.

Figure 1:
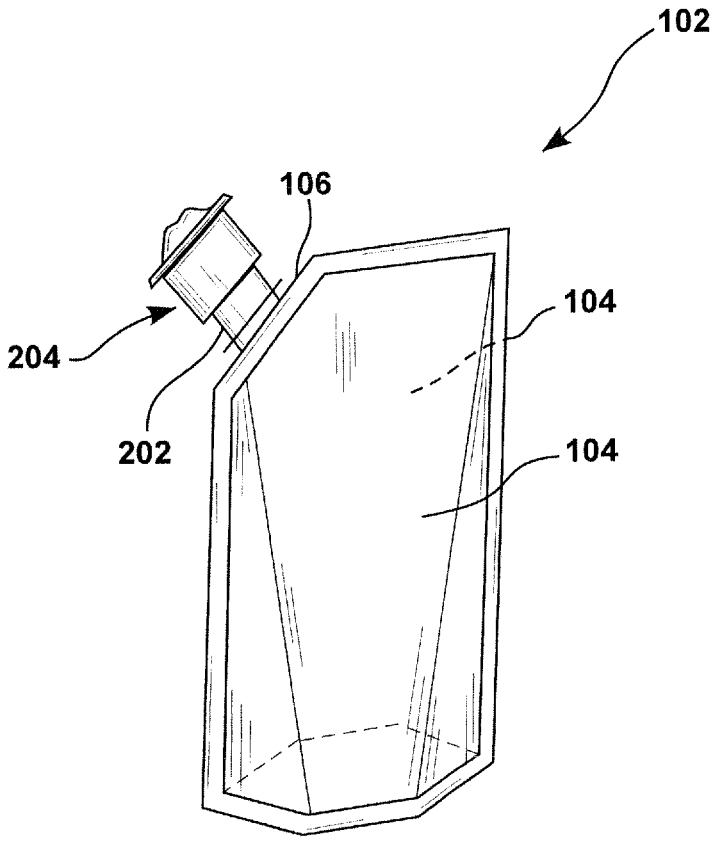
FIG. 1 is a perspective view showing a beverage container having a flexible stand-up pouch 102.

FIG. 1 is a perspective view showing a beverage container having a flexible stand-up pouch 102. The pouch may be constructed with two wall panels 104 with a corner section cut out at the top of the pouch 102 to form a slanted edge 106. A re-sealable spigot 200 (see FIG. 2) extending from the slanted edge 106 may be used by the consumer to dispense the beverage from the pouch 102. The term "re-sealable spigot" means a valve or spout, having a push-pull top 204, which moves up and down a stem 202 to open and close the spigot. By way of example, a push-pull top 204 shown, in FIG. 1 and FIG. 2, may be "pulled" up the stem 202 to open the spigot 200 and "pushed" down the stem 202 to close the spigot 200.

Figure 2:
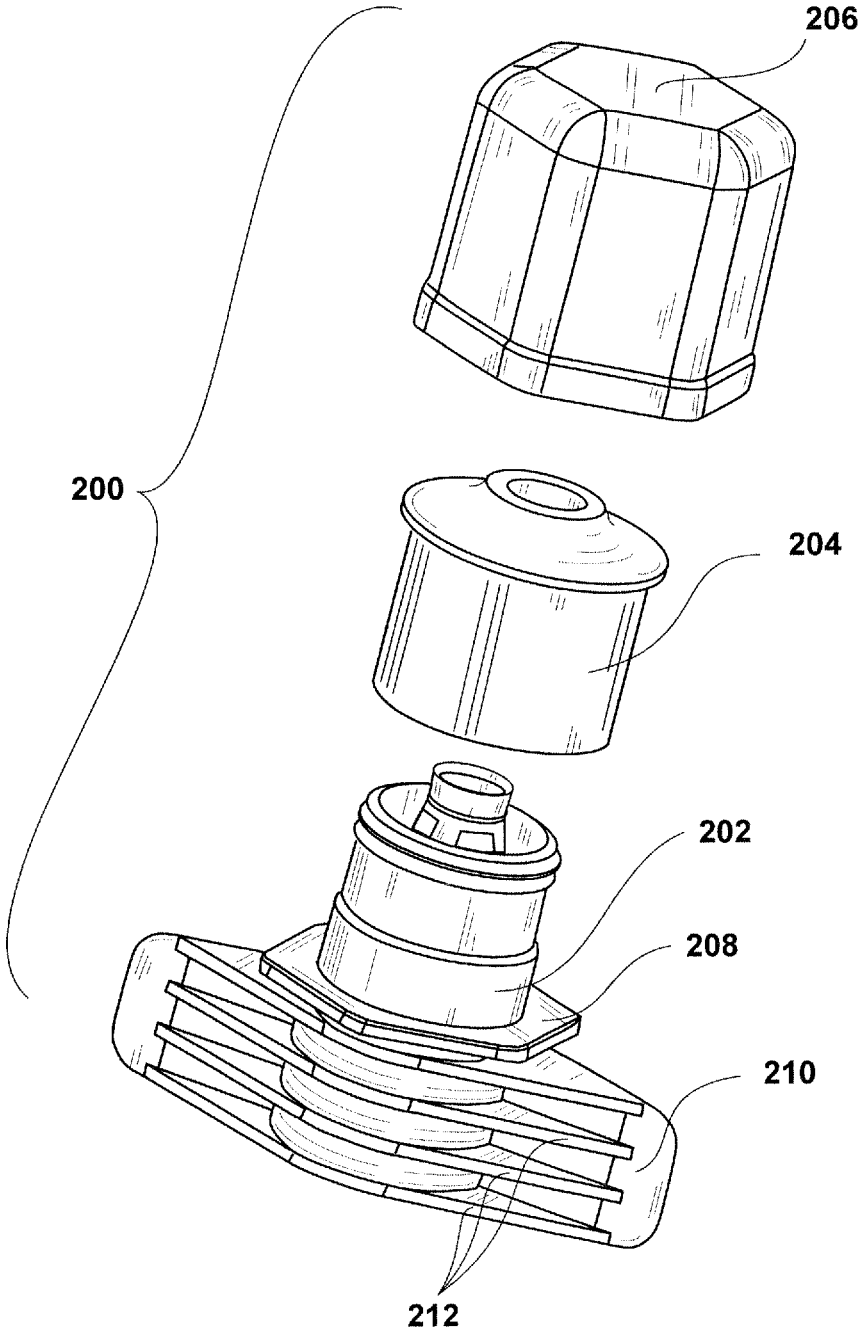
FIG. 2 is an exploded perspective view, partially cut away, of a re-sealable spigot and its individual components.

FIG. 2 is a perspective view of a re-sealable spigot 200 and its individual components. The individual components comprise the stem 202, the push-pull top 204, and the sanitary cap 206. In at least one embodiment of the re-sealable spigot 200, the complete spigot 200 assembly may be formed with a tamper-evident seal. This may be achieved during the manufacturing process by heat-sealing the bottom portion of the sanitary cap 206 to the stem 202 with the re-sealable spigot 200 in the closed position. The tamper-evident seal may subsequently be broken by the consumer by simply twisting and/or pulling on the sanitary cap 206.

Since the physical dimensions of the pouch 102 may vary depending on manufacturing preferences and the particular application, the re-sealable spigot 200 may likewise having varying physical dimensions without straying from the teachings contained herein. For example, for retail distribution of beverage drinks, commercial viability may best be served with a small, lightweight construction. That is, the wall panels 104 may have a lateral height of 160 mm and a horizontal length of 110 mm. The slanted edge 106 may be formed at 45° angle for easy consumption of the beverage from the pouch 102 through the re-sealable spigot 200. Moreover, one of ordinary skill in the art may appreciate that the re-sealable spigot 200 may be configured onto the pouch 102 in countless arrangements.

Further, the lightweight construction of the beverage container may be achieved by selecting the appropriate material, and further facilitated by incorporating a disposable re-usable spigot 200. By way of example, the pouch 102 may be formed from a polyester, polyethylene laminate, wherein the attached re-sealable spigot 200 is comprised of a light polyurethane material capable of withstanding the repetitive open and close movements of the push-pull top 204. The polyethylene layer may provide a heat-sealable interior lining for the pouch 102. Because the polyester does not shrink during the heat-sealing process, various aesthetic features and written materials may be printed on the polyester layer before the pouch 102 is constructed without experiencing distortion during the heat-sealing process. The thickness of the polyester film may be about 12 microns and the thickness of the polyethylene may be about 90 microns. Other material thicknesses may be used where appropriate.

By way of the stem 202, the re-sealable spigot 200 may be fused between the wall panels 104 during the manufacturing process. Upon heat treatment, the wall panels 104 form around the canoe portion 210 of the stem 202. The canoe portion 210 may have one or more horizontal ribs 212 that may provide sufficient friction and resistance so as to create a hermetically sealed pouch 102 prior to receiving a liquid for subsequent dispensing. The push-pull top 204 may be separately formed and placed over the stem 202 since the substantially hollow cylindrical structure of the push-pull top 204 may receive the stem 202 via a friction fit. The sanitary cup 206 may be removed and replaced as necessary to extract the liquid found within the pouch 102, thus, protecting the push-pull top 204 from foreign particulate matter or other unsanitary debris. As illustrated, the sanitary cup 206 may comprise a hollow hexagon shape that may receive the push-pull top 204 in its closed position and latch onto the stem 202 at a hexagonal receiving portion 208. The hexagonal receiving portion 208 may be manufactured in such a way so as to form a snap fit within the inside perimeter of the sanitary cap 206. As one of ordinary skill in the art may appreciate, although a hexagon is shown in the depicted illustrations, one may easily replace the base shape with any multi-sided polygon having three or more sides and likewise come within the spirit and objectives of this disclosure.

FIG. 3 is a cross section of a re-sealable spigot 200 in the sealed position with the sanitary cap 206 in place. The cylindrical stem 202 may have a barrier flange 308 that extends around the circumference of the stem 202 and protrude away from its longitudinal axis. The push-pull top 204 may likewise have an inwardly extending catch flange 306 around the internal circumference of the top 204. The catch flange 306 and barrier flange 308 facilitate the ability of the push-pull top 204 to travel along the stem 202 axis without inadvertent removal and further, allows the top 204 to temporarily lock in the closed position to prevent inadvertent liquid spills.

Similarly, the sanitary cap 206 may contain a flange 304 that extends the entire inside circumference of the sanitary cap 206. The push-pull top 204 may have a lip 302 at the upper most portion of the top 204 that provides for the interlocking with the flange 304 when a places the cap 206 over the push-pull top 204 and exerts a downward force upon the cap 206 so as to temporarily seal the drinking portion of the re-sealable spigot 200. In reversing this process, a user may be able to exert an upward force upon the sanitary cap 206 to remove the cap and expose the push-pull top 204 for liquid extraction. The range of force necessary for placing and removing the cap 206 will vary depending on the size and placement of the interlocking flange structures 304 and 302.

Figure 3A:
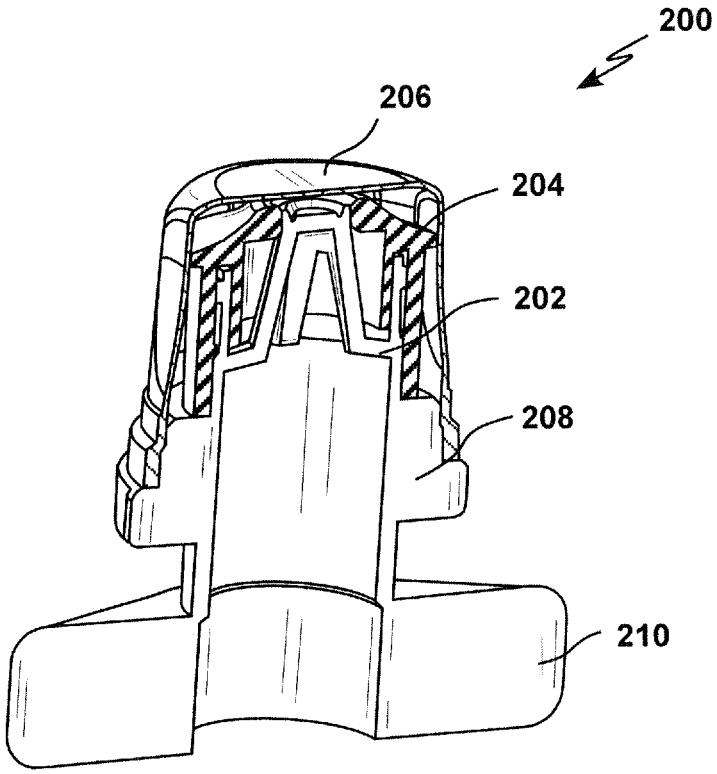
FIG. 3A is a cross section of an alternative embodiment of a re-sealable spigot in the sealed position.
Figure 3B:
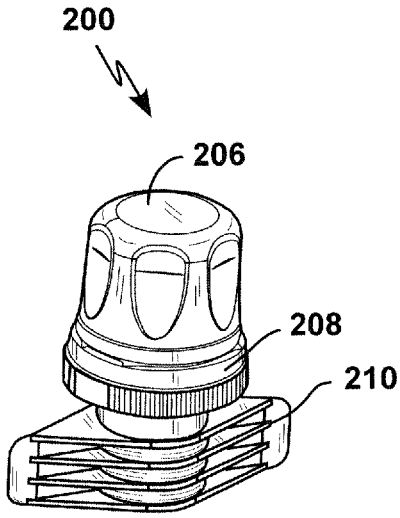
FIG. 3B is a perspective view of the re-sealable spigot of FIG. 3A.
Figure 3C:
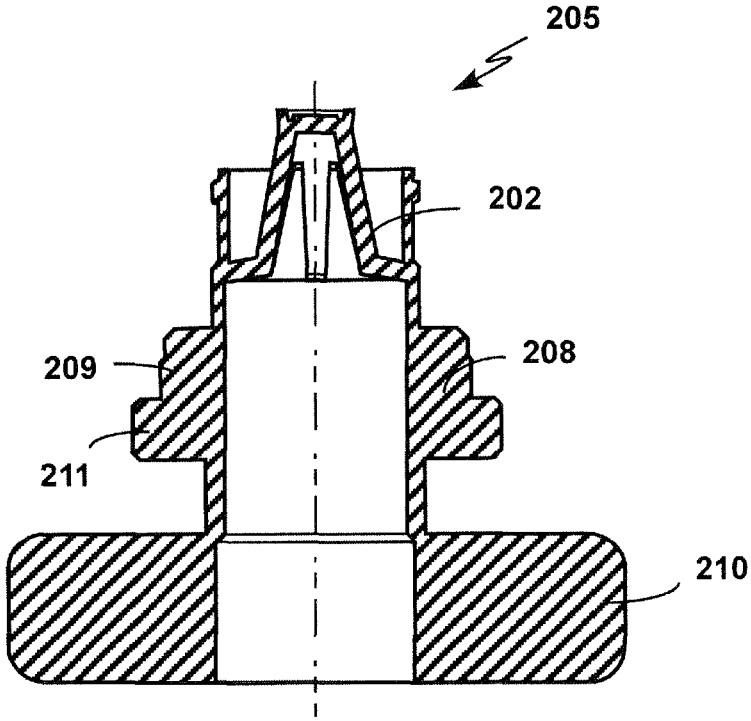
FIG. 3C is a cross section of a cylindrical structure for the re-sealable spigot of FIG. 3A.

FIGS. 3A-C illustrate an alternative embodiment of a re-sealable spigot in a sealed position. In this embodiment, a cylindrical structure 205 includes a canoe portion 210, a base portion 208 above the canoe portion 210, and a stem portion 202 above the base portion 208. The base portion 208 includes a circular portion 209 supported by a flange portion 211. The re-sealable spigot 200 also includes a sanitary cap 206 with a hollow circular shape that receives the push-pull top 204 in its closed position and latches onto the stem 202 at the circular portion 209 of the base portion 208. Similar to the spigot described in connection with FIG. 2, the circular portion 209 of the base portion 208 may be manufactured in such a way so as to form a snap fit within the inside perimeter of the sanitary cap 206.

Figure 4:
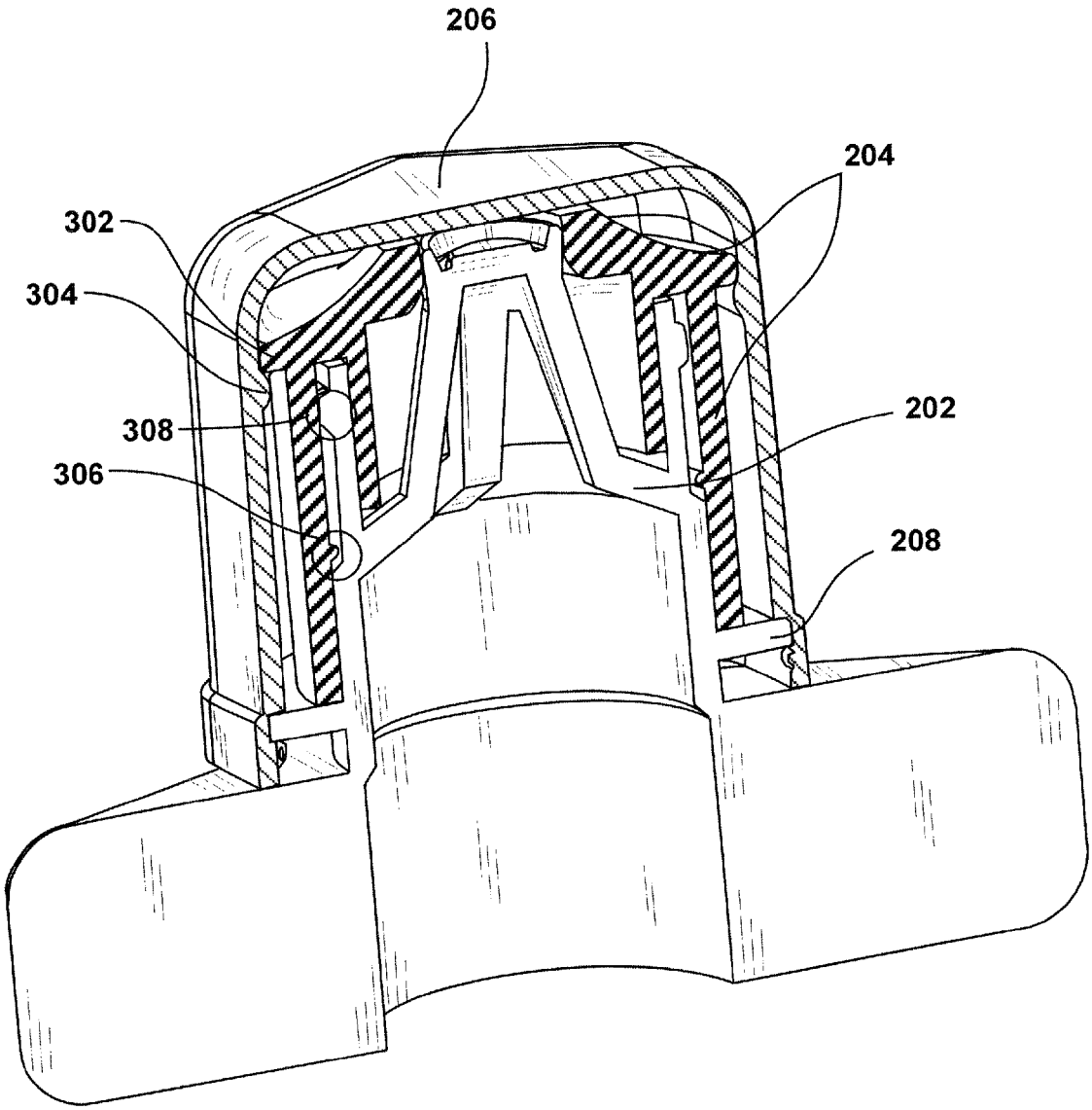
FIG. 4 is a cross section of a re-sealable spigot in the sealed position.

FIG. 4 is a cross section of a re-sealable spigot 200 in the sealed position with the sanitary cap in place. The cylindrical stem 202 may have a barrier flange 308 that extends around the circumference of the stem 202 and protrudes away from its longitudinal axis. The push-pull top 204 may likewise have an inwardly extending catch flange 306 around the internal circumference of the top 204. The catch flange 306 and the barrier flange 308 facilitate the ability of the push-pull top 204 to travel along the stem axis without inadvertent removal and further, allow the top 204 to temporarily lock in the closed position to prevent inadvertent liquid spills.

What is claimed is:

1. A collapsible liquid receptacle having a re-sealable spigot comprising:

a collapsible liquid receptacle and a re-sealable spigot comprising:

a canoe for attaching the spigot to a liquid receptacle, said canoe having a shoulder;

a stem extending from the canoe, comprising:

a base comprising a first flange extending around at least a portion of a circumference of the base; and a tubular upper portion extending from the flange, the upper portion comprising a second flange extending around at least a portion of an outer circumference of the upper portion;

a push-pull fitment for opening and closing the spigot, comprising:

a tubular lower portion slidably attached to the upper portion of the stem;

a third flange extending around at least a portion of an inner circumference of the lower portion for engaging the second flange of the stem when the fitment is in an open position; and a lip extending around an outer circumference of an upper portion of the fitment; and a cap for sealing the spigot, comprising:

a fourth flange extending around at least a portion of an inner circumference of an upper portion of the cap for engaging the lip of the push-pull fitment to provide a seal; and a lower portion configured to abut the shoulder and to engage the first flange of the base to provide a snap fit for securing the cap to the spigot when the spigot is resealed, wherein the lower portion of the cap provides a tamper-evident seal configured to be broken when the cap is removed from the spigot.

2. The collapsible liquid receptacle of claim 1 wherein said collapsible liquid receptacle is a hermetically sealed pouch consisting essentially of polyester and polyethylene.

3. The collapsible liquid receptacle of claim 2 wherein said pouch comprises two wall panels with a corner section cut out to form a slanted edge, and wherein the canoe is further configured to be attached to the slanted edge.

4. The collapsible liquid receptacle of claim 3, wherein the canoe comprises a plurality of ribs for providing a hermetic seal with the two wall panels of the pouch.

* * * * *